United States Patent [19]

Torii et al.

[11] 3,967,844

[45] July 6, 1976

[54] OUTSIDE DOOR HANDLE ASSEMBLY FOR VEHICLES

[75] Inventors: Nozomu Torii, Hekinan; Yosikatsu Furuya, Toyota, both of Japan

[73] Assignee: Aisin Seiki Kabushiki Kaisha, Japan

[22] Filed: Nov. 14, 1974

[21] Appl. No.: 523,744

Related U.S. Application Data

[63] Continuation of Ser. No. 296,970, Oct. 12, 1972, abandoned.

[30] Foreign Application Priority Data

Oct. 14, 1971 Japan ..... 46-81209

[52] U.S. Cl. ..... 292/336.3; 292/210; 292/DIG. 65

[51] Int. Cl.[2] ..... E05C 3/26

[58] Field of Search ..... 292/153, 181, 196, 210, 292/223, 336.3

[56] References Cited

UNITED STATES PATENTS

| | | | |
|---|---|---|---|
| 299,712 | 6/1884 | Adams | 292/210 |
| 812,107 | 2/1906 | Wirfs | 292/210 |
| 2,309,049 | 1/1943 | Curtiss, Jr. et al. | 292/223 X |
| 2,927,812 | 3/1960 | Smith et al. | 292/196 |
| 2,944,848 | 7/1960 | Mandolf | 292/181 |
| 3,544,148 | 12/1970 | Sandor | 292/336.3 |
| 3,606,428 | 9/1971 | Erck et al. | 292/153 |
| 3,652,112 | 3/1972 | Panelli | 292/210 |
| 3,858,921 | 1/1975 | Kuki | 292/336.3 |

*Primary Examiner*—Robert L. Wolfe
*Assistant Examiner*—Carl F. Pietruszka
*Attorney, Agent, or Firm*—Oblon, Fisher, Spivak, McClelland & Maier

[57] ABSTRACT

An outside door handle assembly for actuating a door latch mechanism of vehicle doors, comprising a base member secured to the vehicle door, lever means pivotally mounted upon the base member and operably connected to the door latch mechanism, a manually operable handle member pivotally mounted upon the lever means, and locking means normally locking the handle member to the base member, characterized in that the handle assembly is rotated in a door opening direction only when the handle member is initially operated, so that an undesired door opening, such as, for example, due to the force of inertia from an automobile collision at the door location, can be prevented.

6 Claims, 5 Drawing Figures

OUTSIDE DOOR HANDLE ASSEMBLY FOR VEHICLES

This is a continuation of application Ser. No. 296,970, filed Oct. 12, 1972 now abandoned.

BACKGROUND OF THE INVENTION

This invention relates generally to vehicle door handle assemblies, and more particularly to an improved latch operating outside door handle assembly.

The conventional latch operating door handle has a serious drawback in that in case of an automoble collision at the door location the door latch mechanism might be released by the force of inertia of the handle member itself, which of course leads to an unintentional door opening which in turn may cause serious casualties.

One of the improved door handle assemblies designed to prevent this occurrence is of the type which uses a great biasing force against operation of the door handle. This type of assembly however has such demerits, such as, for example, the operational feeling of the door handle is so large, and the handle assembly is too great to install into a small or limited size vehicle door, that such assembly is not practical.

SUMMARY OF THE INVENTION

Accordingly, it is an object of the present invention to provide an improved door latch operating outside door handle assembly which will overcome the above conventional drawbacks.

Another object of the present invention is to provide a compact and yet safe outside door handle assembly for a vehicle door.

The foregoing objectives are achieved according to this invention through the provision of a base member to which is pivotally attached lever means and a manually operable door handle. The lever is connected to the door latch mechanism and the handle is pivotable relative to the lever means, while locking means are provided between the handle and the base member. Initial rotation of the handle unlocks the handle from the base member, whereby further rotation of the handle actuates the levers and the latch mechanism.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENT

Figure 1:
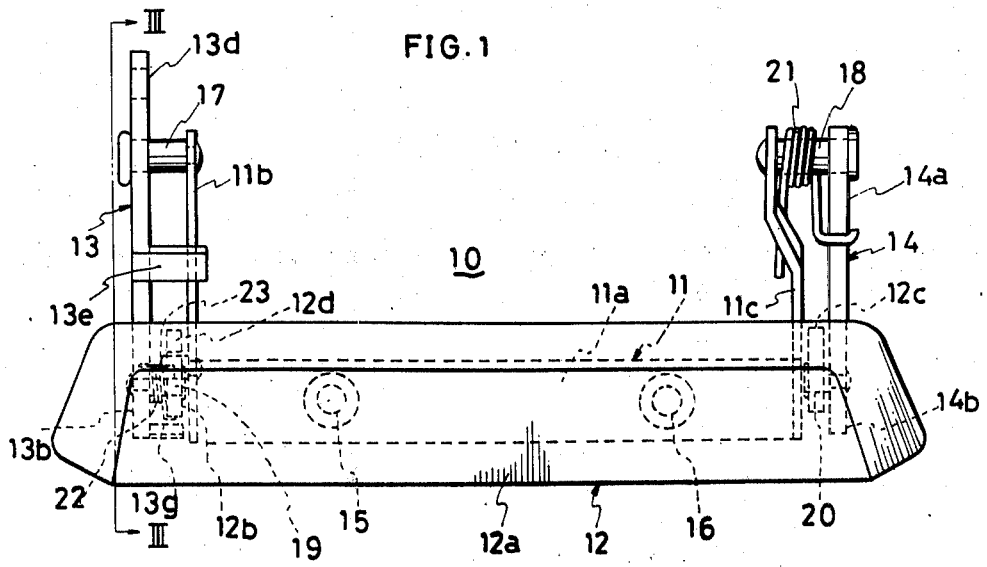
FIG. 1 is a front view of an outside door handle assembly constructed according to this invention, the handle assembly being in its inoperative or normal position.

Referring now to the drawings, a door handle assembly, generally indicated by the reference character 10 is conventionally mounted upon a vehicle door outer panel, not shown, and includes an elongated base member generally indicated by the reference character 11, an elongated main handle generally indicated by the reference character 12 and two side levers generally indicated by the reference characters 13 and 14. The base member 11 comprises an elongated base portion 11*a* and two crank arms 11*b* and 11*c* respectively provided at each end of the elongated base portion 11*a*, as clearly shown in FIG. 1. Elongated base portion 11*a* is fixed to the vehicle door by means of two bolts 15 and 16. The first side lever 13, being of substantially Z-shaped construction as shown in FIGS. 3 through 5, is pivotally mounted at the upper end of a middle portion 13*a* thereof, along with the upper end of the first crank arm 11*b* of the base member 11, by means of pin 17, while the second side lever 14, being of substantially L-shaped construction as is clearly shown in FIG. 2, is pivotally mounted at the upper end of a vertical portion 14*a* thereof along with the upper end of the second crank arm 11*c* of the base member 11. by means of a pin 18.

Figure 2:
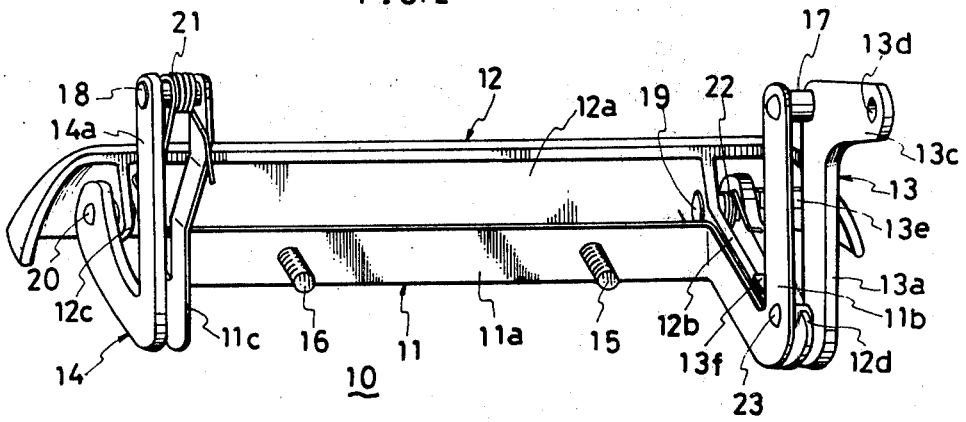
FIG. 2 is a rear perspective view of the door handle assembly of FIG. 1.

The elongated main handle 12 comprises an elongated finger gripping portion 12*a* and two inwardly extending flanges 12*b* and 12*c* which are respectively provided at each end of the elongated finger gripping portion 12*a*, as is clearly shown in FIG. 2. The first flange 12*b* is longer than the second flange 12*c* and has a hook 12*d* at its inwardly extended end. This first flange 12*b* is pivotally mounted at its root portion, along with a lower portion 13*b* of the first lever 13, by means of a pin 19, as is shown in FIG. 3, while the second flange 12*c* is pivotally mounted at the root portion thereof along with an underside portion 14*b* of the second lever 14, by means of a pin 20, as is shown in FIGS. 1 and 2.

Provided at the upper end of an upper side portion 13*c* of the first lever 13 is a bore 13*d* which receives a rod, not shown, of a conventional door latch mechanism, also not shown, so as to operate the latch mechanism between the latched and unlatched positions by rotation of the first lever 13. A return spring 21, wound around the peripheral surface of the pin 18, is engaged at one end with the second crank arm 11*c* of the base member 11, and at its other end with the vertical portion 14*a* of the second lever 14 so that the main handle 12 and the two levers 13 and 14 can be resiliently urged to rotate in a clockwise direction as shown in FIGS. 3 to 5. Upon the middle portion 13*a* of the lever 13 there is provided a first stop projection 13*e* which is positioned so as to be able to come into contact with the vertically extending portion of the second crank arm 11*b* of the base member 11 for preventing the lever 13 from moving past its normal inoperative position of FIG. 3, when released from its actuated position of FIG. 5.

Figure 3:
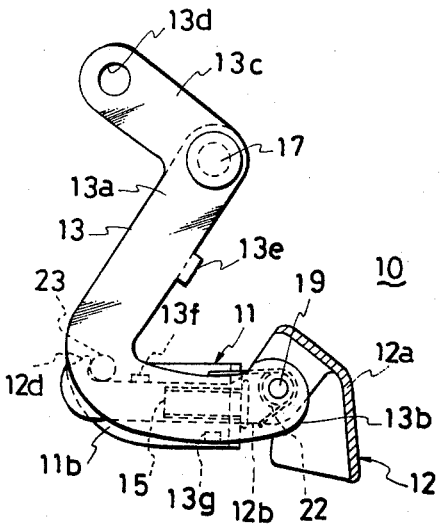
FIG. 3 is a sectional view taken along line III-III of FIG. 1.
Figure 4:
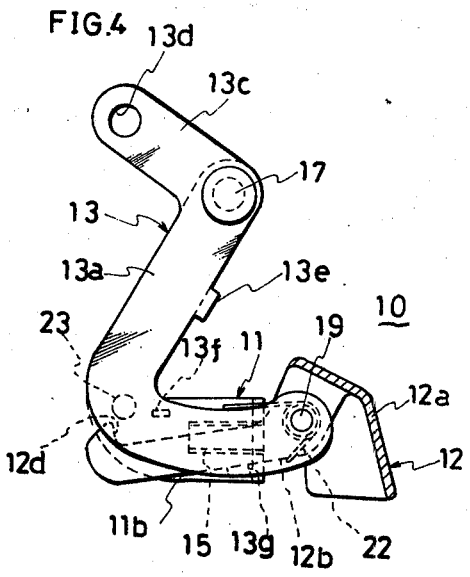
FIG. 4 is a view similar to that of FIG. 3, showing the handle in its partially rotated position.
Figure 5:
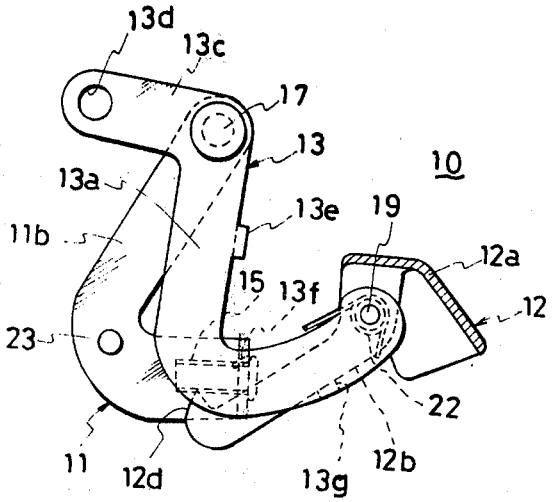
FIG. 5 is a view similar to that of FIG. 3, showing the handle and levers in their fully rotated position.

Similarly, a return spring 22, wound around the peripheral surface of the pin 19, is engaged at one end with the first flange 12*b* of the main handle 12 and at its other end with the underside portion 13*b* of the lever 13 so that the main handle 12 can be resiliently urged to rotate in a clockwise direction as shown in FIGS. 3 to 5. At the upper part of lever portion 13*b* of the lever 13 there is provided a second stop projection 13*f* which is positioned so as to be able to come into contact with the upper surface of the horizontally extending portion of first crank arm 11*b* for preventing the main handle 12 from moving past its normal inoperative position of FIG. 3 when released from its actuated position of FIG. 5. A third projection 13*g* is also provided at the lower part of lower portion 13*b* of lever 13 and when the finger-gripping portion 12*a* of the main handle 12 is manually rotated by a finger-gripping operation in the counter-clockwise direction from the normal position of FIG. 3, the third stop projection 13*g* comes into contact with the bottom surface of the flange 12*b*, as shown in FIG. 4, and prevents a further rotation of the main handle 12 relative to portion 13*b* of lever 13, continued rotation of handle 12 thereby actuating lever 13.

In normal or inoperative position of the main handle 12 as shown in FIG. 3, the hook 12*d* is engaged with a pin 23 provided within the first crank arm 11*b* of the base member 11 so as to prevent or lock the counter-clockwise rotation of the main handle 12 except when the handle 12 is first manually rotated by the finger-gripping operation thereof. The main handle 12 is so arranged and designed that its center of gravity occupies a position as close as possible to the center of pivotal movement thereof, that is, pin 19.

In operation, when an operator grips the elongated finger gripping portion 12*a* of the main handle 12, the main handle 12 is rotated about the pin 19 in a counter clockwise direction against the biasing force of the spring 22 so as to disengage the hook 12*d* from the pin 23, as is shown in FIG. 4. Then the main handle is further rotated in the same direction, together with the two levers 13 and 14, about the pins 17 and 18 against the biasing force of the spring 21, as is shown in FIG. 5. By this counter clockwise rotation of the lever 13, the door latch mechanism operably connected thereto is actuated to its unlatched position and the door is opened.

When the vehicle door receives a lateral force, such as for example, in case of an accident where the other car collides with the vehicle's door, the lever 13 of the handle assembly 10 can not be operated, because in such case, the lever 13 is still locked upon the base member 11 by the hook 12*d* thereof. Consequently, the door latch mechanism operably connected to the lever 13 cannot be actuated and accordingly the door remains in its closed position.

Obviously, many modifications and variations of the present invention are possible in light of the above teachings. It is to be understood therefore, that within the scope of the appended claims, the present invention may be practiced otherwise than as specifically described herein.

What is claimed as new and desired to be secured by Letters Patent of the United States is:

1. An outside door handle assembly for actuating a door latch mechanism of vehicle doors, comprising:

a base member having a pair of arms being secured to the vehicle door;

a pair of levers respectively being pivotally mounted upon said pair of arms, one of said levers being operably connected to said door latch mechanism;

a manually operable main door handle pivotally mounted upon said pair of levers;

biasing means constantly biasing said main door handle so as to maintain said main door handle in a normal non-operative position;

locking means normally locking the pivotal movement of said levers and said latch mechanism, said locking means releasing said levers and said latch mechanism only when said main door handle is initially rotated from said normal non-operative position in a door opening direction; and means for relatively non-pivotally engaging said main door handle with said one of said pair of levers upon a further door opening rotation of said main door handle, whereby said main door handle and said pair of levers are rotatable as a unit about the pivotal mounting point of said levers on said pair of arms for unlatching the door latch mechanism.

2. An outside door handle assembly as set forth in claim 1, wherein said biasing means comprises two return springs, one of which is provided between one of said pair of levers and the corresponding one of said arms of said base member, and the other of which is provided between the other of said pair of levers and said main door handle.

3. An outside door handle assembly as set forth in claim 1, further comprising stop means for preventing said levers and said main door handle from being rotated past their normal inoperative positions by said biasing means upon closing said door.

4. An outside door handle assembly as set forth in claim 1, wherein a spaced portion is provided between said main door handle and said base member for facilitating manual operation of said handle.

5. An outside door handle assembly as set forth in claim 1, wherein said locking means includes a pin provided on said base member upon which is pivotally mounted a flange portion of said door handle having a hook disposed on an inwardly extending end thereof.

6. An outside door handle assembly as set forth in claim 1, wherein the center of gravity of said main door handle is substantially positioned at the center of pivotal movement thereof.

* * * * *